US006737610B1

(12) United States Patent
Horn et al.

(10) Patent No.: US 6,737,610 B1
(45) Date of Patent: May 18, 2004

(54) STRANDED HEATER WIRE WITH SENSOR

(75) Inventors: James A. Horn, North Webster, IN (US); Steven L. Hardin, Warsaw, IN (US)

(73) Assignee: Dekko Technologies, Inc., North Webster, IN (US)

( * ) Notice: Subject to any disclaimer, the term of this patent is extended or adjusted under 35 U.S.C. 154(b) by 0 days.

(21) Appl. No.: 10/338,617

(22) Filed: Jan. 8, 2003

(51) Int. Cl.[7] ..... H05B 1/00

(52) U.S. Cl. ..... 219/212; 219/211; 219/529; 219/549

(58) Field of Search ..... 219/212, 211, 219/217, 528, 529, 544, 545, 549; 392/425, 432, 435

(56) References Cited

U.S. PATENT DOCUMENTS

| | | | | |
|---|---|---|---|---|
| 2,745,943 A | | 5/1956 | Safford | 219/46 |
| 3,222,497 A | | 12/1965 | Gordon, Jr. | 219/212 |
| 3,410,984 A | | 11/1968 | Sanford et al. | 219/212 |
| 3,628,093 A | | 12/1971 | Crowley | 317/18 |
| 4,205,223 A | | 5/1980 | Cole | 219/501 |
| 4,309,597 A | | 1/1982 | Crowley | 219/549 |
| 4,547,658 A | * | 10/1985 | Crowley | 219/212 |
| 4,607,154 A | | 8/1986 | Mills | 219/505 |
| 4,677,281 A | | 6/1987 | Mills | 219/505 |
| 4,684,785 A | | 8/1987 | Cole | 219/212 |
| 4,695,703 A | * | 9/1987 | Williams et al. | 219/212 |
| 4,910,391 A | * | 3/1990 | Rowe | 219/549 |
| 5,081,341 A | * | 1/1992 | Rowe | 219/212 |
| 5,861,610 A | | 1/1999 | Weiss | 219/497 |
| 6,252,198 B1 | * | 6/2001 | Malkin | 219/212 |
| 6,294,770 B1 | * | 9/2001 | Hasegawa et al. | 219/544 |
| 6,310,332 B1 | * | 10/2001 | Gerrard | 219/212 |
| 6,555,787 B1 | * | 4/2003 | Horn et al. | 219/212 |

* cited by examiner

*Primary Examiner*—Henry Bennett
*Assistant Examiner*—Fadi H. Dahbour
(74) *Attorney, Agent, or Firm*—Taylor & Aust. P.C.

(57) ABSTRACT

A resistive heating conductor having at least one strand, a first electrical insulation surrounding the resistive heating element, a sensor conductor helically disposed around the first electrical insulation and a second electrical insulation surrounding both the sensor conductor and the first electrical insulation.

15 Claims, 3 Drawing Sheets

STRANDED HEATER WIRE WITH SENSOR

BACKGROUND OF THE INVENTION

1. Field of the Invention

The present invention relates to a heater system, and a method of operation thereof, which utilizes a two conductor element, and, more particularly, to an electric heating blanket which incorporates a single conductor heating element and a single conductor sensing element.

2. Description of the Related Art

Blankets are woven from a variety of materials including wool, cotton, synthetics, and various animal and vegetable fibers. Blankets are used as a shawls, bed coverings and horse coverings. The blanket making of primitive people is one of the finest remaining examples of early domestic artwork. For example, the blankets of Mysore, India, are famous for their fine, soft texture. The loom of the Native American, though simple in construction, can produce blankets so closely woven as to be waterproof. The Navaho, Zu ñi, Hopi, and other Southwestern Native Americans are noted for their distinctive, firmly woven blankets. The Navahos produced beautifully designed blankets characterized by geometrical designs woven with yarns colored with vegetable dyes. The ceremonial Chilcat blanket of the Tlingit of the Northwest, is generally woven with a warp of cedar bark and wool and a weft of goats' hair. Blankets, like society, have changed significantly over the years and it was in the 20th century that the electric blanket, with electric wiring between layers of fabric, gained wide popularity.

The direct conversion of electric energy into heat was first described by the English physicist James P. Joule. According to Joule's law, a conductor carrying a current generates heat at a rate proportional to the product of the resistance of the conductor and the square of the current. It is the use of this principle, of applying electrical energy to a distributed resistance incorporated in a blanket, which provides warmth to the user. Joule's law also points to a potential problem, if resistance is locally increased, in a distributed resistive element, more heat is produced in that localized area causing a local hot spot.

In spite of the advantages to the users of electric blankets, consumers have voiced concerns. Manufactures of electric blankets have addressed consumer concerns with scientific studies, incorporation of safety features and marketing techniques. Regardless of the manufacturer's care in manufacturing electric blankets, localized hot spots can occur in an electric blanket as a result of either a manufacturing defect, handling damage or consumer misuse. A localized hot spot in an electric blanket may cause damage to the electric blanket, property loss and/or injury to the user.

U.S. Pat. No. 5,861,610 (Weiss) discloses a heater wire with a first conductor for heat generation and a second conductor for sensing the temperature. The second conductor is made of 99.5% nickel. The first conductor and second conductor are each wound as coaxial spirals with an insulating material isolating the two conductors. A problem with the Weiss invention is that winding two coaxial spirals separated by an insulating material is rather expensive.

What is needed in the art is an electric blanket with a two conductor heating element which is economical to manufacture, is safe and provides disconnection if a localized heating problem occurs therein.

SUMMARY OF THE INVENTION

The present invention provides a two wire heating element. One wire is electrically resistive for the production of heat and the second wire is utilized for the sensing of the temperature of the assembly.

The invention comprises, in one form thereof, a resistive heating conductor having at least one strand, a first electrical insulation surrounding the resistive heating element, a sensor conductor helically disposed around the first electrical insulation and a second electrical insulation surrounding both the sensor conductor and the first electrical insulation.

An advantage of the present invention is that if the heating conductor overheats, electrical power thereto is removed.

Another advantage is that localized overheating of a resistive conductor is detected.

Yet another advantage is that the temperature at which a localized heating problem is detected is predetermined by the selection of the melting temperature of an electrical insulation.

A further advantage is that the electrical heating element is easily manufactured as a stranded resistive conductor with a sensor conductor helically wound around an insulation covering the stranded heating resistive conductor.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
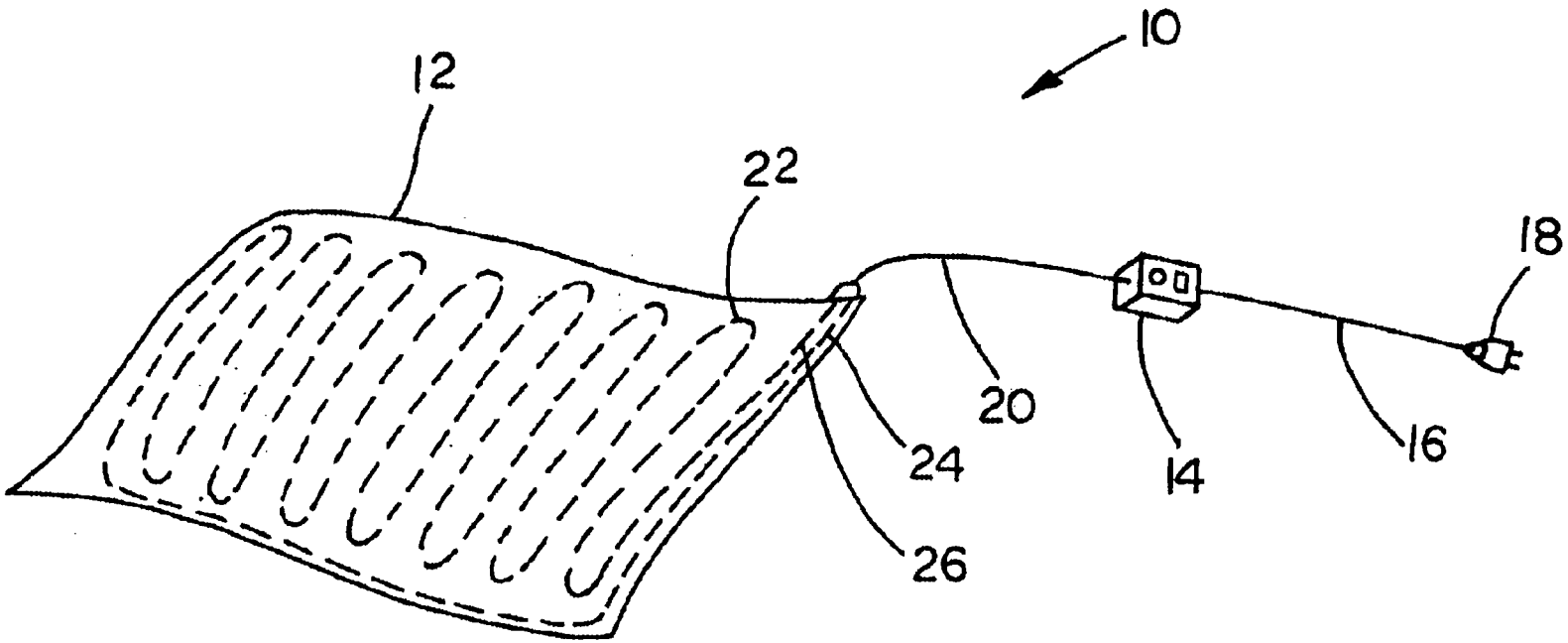
FIG. 1 is a perspective view of one embodiment of an electric heating blanket apparatus of the present invention.

Referring now to the drawings, and more particularly to FIG. 1, there is shown a two conductor heating element and controller in the form of an electric blanket apparatus 10 which generally includes blanket 12, control assembly 14, power cord 16, plug 18, connecting cord 20, heating assembly 22, a first end 24 of heating assembly 22 and a second end 26 of heating assembly 22.

Blanket 12 is a blanket which is sized for a bed and includes heating assembly 22 as an integral part of blanket 12. Blanket 12 may be of two layer construction with heater assembly 22 therebetween.

Figure 2:
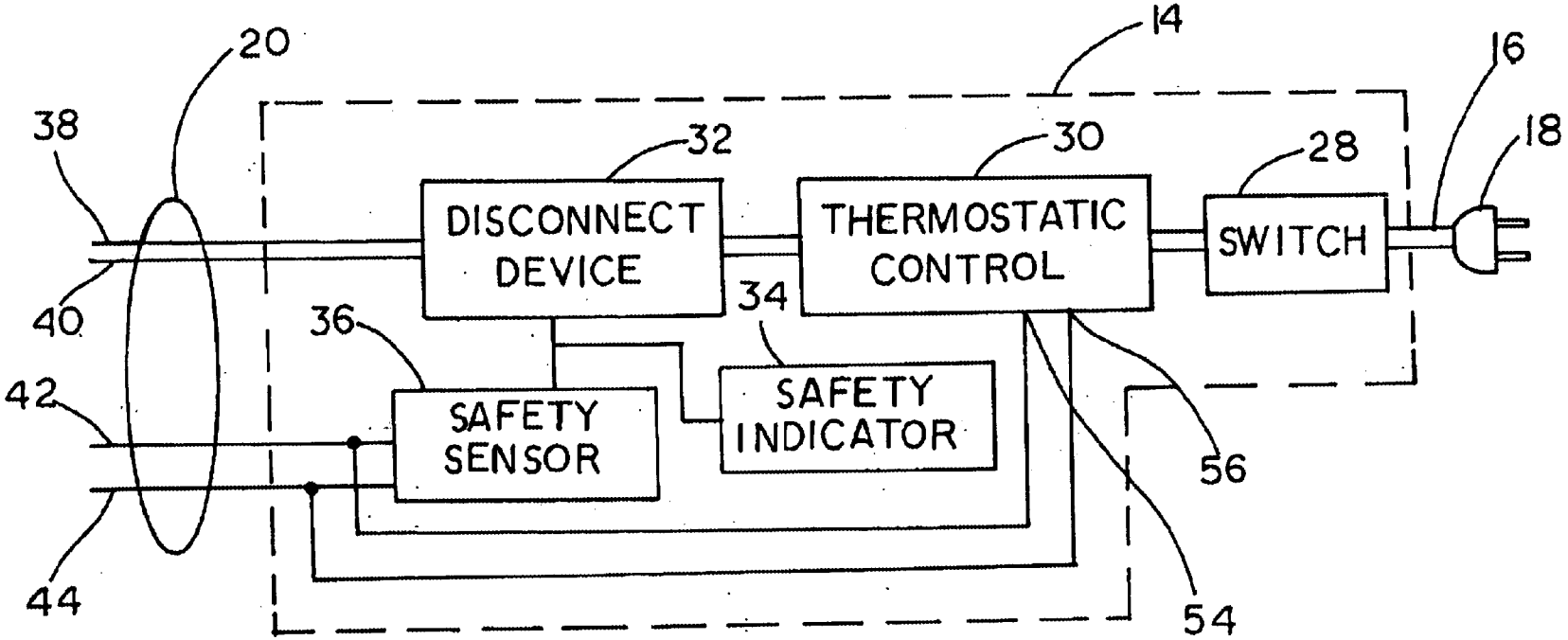
FIG. 2 is a schematic block diagram of a control device of the electrical heating blanket apparatus depicted in FIG. 1.

Now additionally referring to FIG. 2, control device 14 includes switch 28, thermostatic control 30, disconnect device 32, safety indicator 34, safety sensor 36, first power conductor 38, second power conductor 40, first sensor conductor 42 and second sensor conductor 44.

Switch 28 is a user operable device capable of turning off and on electrical blanket apparatus 10. Switch 28 is electrically coupled to power cord 16 and when switch 28 is in an on position, electrical power is supplied therethrough to thermostatic control 30.

Thermostatic control 30 has two sensor inputs 54 and 56 which use an electrical signal to sense the temperature within heating assembly 22 and if the temperature is below a user selected temperature then thermostatic control 30 closes a circuit to provide an electrical connection therethrough. If the temperature of blanket 12 is equal to or above a user selected temperature, thermostatic control 30 opens a circuit thereby disconnecting an electrical connection to heating assembly 22. As a safety consideration, if no input is electrically coupled to sensor inputs 54 and 56, thermostatic control 30 will not close the electrical connection.

Disconnect device 32 is electrically coupled in series with heating assembly 22 in order to disconnect electrical power to heating assembly 22 when a disconnect signal from safety sensor 36 is received. Disconnect device 32 is resetable so that control assembly 14 may be used with another blanket 12/heater assembly 22. Alternatively, disconnect device 32 may contain a sacrificial element to disconnect heater element 22 from control assembly 14.

Safety indicator 34 provides an indication to the user as to whether heater element 22 has been disconnected because of a problem detected by control assembly 14. Safety sensor 36 is electrically connected to first sensor conductor 42 and second sensor conductor 44. Safety sensor 36 senses an electrical characteristic such as voltage and in the event a voltage is detected, above a predetermined value, safety sensor 36 outputs a disconnect signal to disconnect device 32 and safety indicator 34.

First power conductor 38 and second power conductor 40 are connected to disconnect device 32. First sensor conductor 42 and second sensor conductor 44 are electrically interconnected with safety sensor 36 and thermostatic control 30. First power conductor 38, second power conductor 40, first sensor conductor 42 and second sensor conductor 44 are all contained in connecting cord 20 which is directed towards and interconnected with heating assembly 22 of blanket 12.

Figure 3:
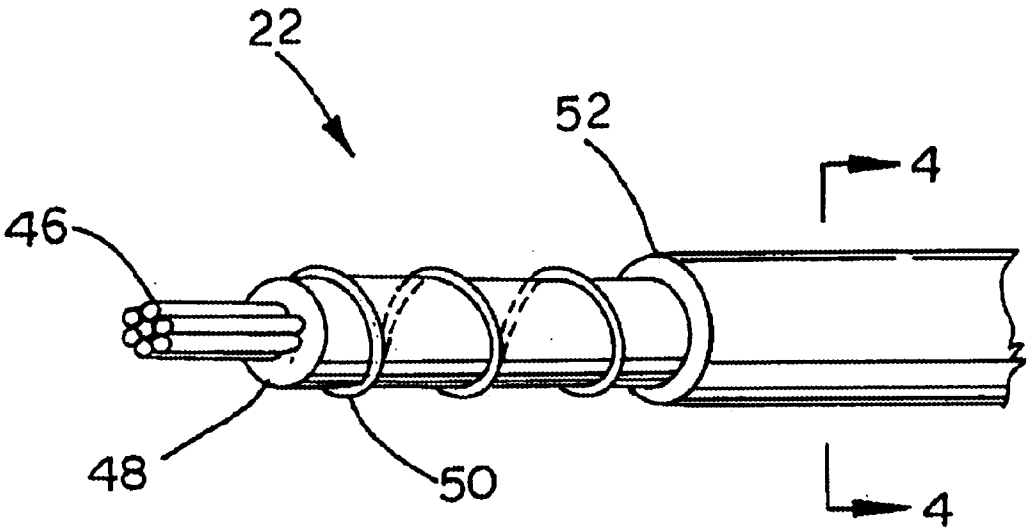
FIG. 3 is a partially sectioned perspective view of a heating element which is disposed within the electrical heating blanket apparatus of FIG. 1.

Now additionally referring to FIG. 3, heating assembly 22 includes heating conductor 46, first insulation layer 48, sensing conductor 50 and second insulating layer 52. Heating conductor 46 is comprised of a seven strand heating wire made of a resistive conductor such as a copper nickel alloy. First end 24 of heating assembly 22 contains one end of heating conductor 46, which is electrically connected to first power conductor 38, by way of an interconnection proximate blanket 12. Second end 26 of heating assembly 22 also contains another end of heating conductor 46 which is electrically connected to second power conductor 40.

First insulation layer 48 is a plastic which is formulated to be thermally conductive and to melt at a predetermined temperature, such as when a portion of heating conductor 46 overheats. The temperature at which first insulation layer 48 melts is such that an overheating of heating conductor 46 will not cause injury or a fire. First insulation layer 48 is a monolithic extrusion surrounding heating conductor 46. If first insulation layer 48 melts, sensing conductor 50 is not constrained from contacting heating conductor 46. At such a juncture electrical contact between heating conductor 46 and sensing conductor 50 is possible. Electrical contact between heating conductor 46 and sensing conductor 50 is detected by safety sensor 36, which causes disconnect device 32 to remove electrical power from first power conductor 38 and second power conductor 48 and thus from heating conductor 46.

Figure 4:
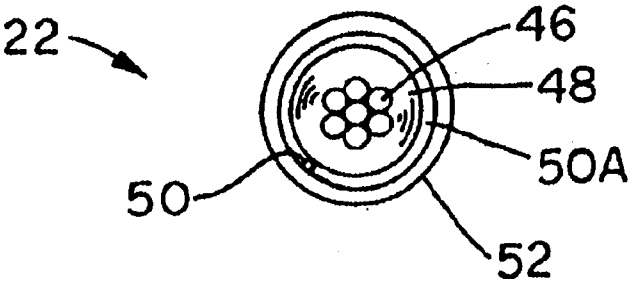
FIG. 4 is a sectional view of the heating element shown in FIG. 3, taken along line 4—4 of FIG. 3.

The two ends of sensing conductor 50 are electrically coupled, respectively, to first sensor conductor 42 and second sensor conductor 44. Sensing conductor 50 is at least a single strand of material which exhibits a resistive temperature coefficient that is monitored by thermostatic control 30 in order to regulate the temperature of electrical blanket apparatus 10. Sensing conductor 50 is arranged in a helical fashion on top of first insulation layer 48. Each end of sensing conductor 50 is electrically coupled to safety sensor 36 by way of first sensor conductor 42 and second sensor conductor 44. In the event heating conductor 46 comes into electrical contact with sensing conductor 50, safety sensor 36 detects the electrical connection and disconnect device 32 disconnects electrical power from heating conductor 46. The layer of helically wound sensing conductor 50, as shown in FIG. 4, includes a cross sectional view of sensing conductor 50 in area 50*a*.

Heating conductor 46 is made of an electrically resistive material such as a resistive metal alloy, and in the preferred embodiment, a copper nickel alloy, providing a distributed heating along the length of heating assembly 22 when electrical power is supplied thereto. Even though heating conductor 46 can be a single strand, in the preferred embodiment, heating conductor 46 is multi-strand. Heating conductor 46 is coupled to control device 14 by way of connecting cord 20.

Second insulation layer 52 is electrically nonconductive and is thermally conductive allowing heat generated in heating conductor 46 to be conducted outwardly to blanket 12. Second insulation layer 52 is formulated to not melt or to melt at a temperature higher than first insulation layer 48, thereby allowing heating conductor 46 to come into contact with sensing conductor 50, yet containing melted first insulation layer 48. Alternatively, second insulation layer 52 may constrict upon being heated thereby forcing sensing conductor 50 into proximate contact with heating conductor 46.

Blanket 12 has a combustion temperature, which is the temperature at which blanket 12 will combust in the presents of atmospheric amounts of oxygen. First insulation layer 48 has a melting temperature which is selected to be less than the combustion temperature of blanket 12.

During operation, electrical power is supplied to heating assembly 22 by way of control assembly 14. Thermostatic control 30 of control assembly 14, senses the electrical resistance of sensing conductor 50, which relates to the temperature of heating assembly 22. The sensed temperature of heating assembly 22 is used to selectively supply power to heating assembly 22 thereby controlling the temperature of heating assembly 22. In the event that there is a localized change in resistance of heating conductor 46, thereby causing a localized rise in the temperature of heating assembly 22, also known as a localized hot spot, then first insulation layer 48 in the area of the elevated temperature, melts allowing sensing conductor 50 to contact heating conductor 46. Electrical voltage present on sensing conductor 50, at the point of contact with heating conductor 46, is conducted to safety sensor 36, by way of first sensor conductor 42 and/or second sensor conductor 44. Voltage detected by safety sensor 36 causes safety sensor 36 to send a signal to disconnect device 32, which then disconnects electrical power from first power conductor 38 and second power conductor 40. The signal sent to disconnect device 32 is also sent to safety indicator 34, which provides a visual display that a fault has been detected in heating assembly 22 and that heating assembly 22 has been electrically disconnected.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A heating blanket, comprising:

a blanket;

a heating element routed within said blanket, said heating element comprising:

a resistive heating conductor having at least one strand;

a first electrical insulation surrounding said resistive heating element;

a sensor conductor helically disposed around said first electrical insulation; and a second electrical insulation surrounding both said sensor conductor and said first electrical insulation, said second electrical insulation having a higher melting temperature than said first electrical insulation; and a control electrically coupled with said sensor conductor and said resistive heating conductor.

2. The heating blanket of claim 1, wherein said resistive heating conductor includes a multi-strand conductor.

3. The heating blanket of claim 1, wherein said first electrical insulation has a melting temperature, if said melting temperature is exceeded electrical contact occurs between said sensor conductor and said resistive heating conductor.

4. The heating blanket of claim 1, wherein said resistive heating conductor is made of a copper-nickel alloy.

5. A heating element, comprising:

a resistive heating conductor having at least one strand;

a first electrical insulation surrounding said resistive heating element;

a sensor conductor helically disposed around said first electrical insulation, said sensor conductor having an electrical characteristic of electrical resistance which changes in relation to a temperature of said sensor conductor; and a second electrical insulation surrounding both said sensor conductor and said first electrical insulation.

6. The heating element of claim 5, wherein said resistive heating conductor includes seven strands.

7. The heating element of claim 5, wherein said first electrical insulation has a melting temperature which if exceeded allows electrical contact between said sensor conductor and said resistive heating conductor.

8. The heating element of claim 5, wherein said resistive heating conductor is made of an electrically resistive alloy.

9. A method of controlling an electric blanket, comprising the steps of:

sensing a temperature of a heating element in the electric blanket, said heating element including a resistive heating conductor, an electrical insulation surrounding said resistive heating conductor and a sensor conductor helically disposed around said electrical insulation, an other electrical insulation surrounding both said sensor conductor and said electrical insulation, said other electrical insulation having a higher melting temperature than said electrical insulation;

selectively applying electric power to said heating element based on said temperature; and sensing a localized hot spot in said heating element.

10. The method of claim 9, further comprising the step of electrically disconnecting said heating element when said localized hot spot is sensed.

11. A heating blanket, comprising:

a blanket;

a heating element routed within said blanket, said heating element comprising:

a resistive heating conductor having at least one strand;

a first electrical insulation surrounding said resistive heating element;

a sensor conductor helically disposed around said first electrical insulation; and a second electrical insulation surrounding both said sensor conductor and said first electrical insulation; and a control electrically coupled with said sensor conductor and said resistive heating conductor;

wherein said blanket has a combustion temperature and said first electrical insulation has a melting temperature, said melting temperature being less than said combustion temperature.

12. A heating blanket, comprising:

a blanket;

a heating element routed within said blanket, said heating element comprising:

a resistive heating conductor having at least one strand;

a first electrical insulation surrounding said resistive heating element;

a sensor conductor helically disposed around said first electrical insulation, said sensor conductor having an electrical characteristic of electrical resistance which changes in relation to a temperature of said sensor conductor;

a second electrical insulation surrounding both said sensor conductor and said first electrical insulation; and a control electrically coupled with said sensor conductor and said resistive heating conductor.

13. The heating blanket of claim 12, wherein said control utilizes said electrical characteristic to regulate electrical power supplied to said resistive heating conductor and thereby control a temperature of said blanket.

14. A heating blanket, comprising:

a blanket;

a heating element routed within said blanket, said heating element comprising:

a resistive heating conductor having at least one strand;

a first electrical insulation surrounding said resistive heating element;

a sensor conductor helically disposed around said first electrical insulation; and a second electrical insulation surrounding both said sensor conductor and said first electrical insulation; and a control device electrically coupled with said sensor conductor and said resistive heating conductor, said control device including:

a safety sensor electrically coupled to said sensor conductor, said safety sensor outputting a disconnect signal when said sensor conductor comes into electrical contact with said resistive heating conductor;

a disconnect device electrically coupled in series with said resistive heating conductor, said disconnect device electrically coupled to said safety sensor and configured to disconnect electrical power to said resistive heating conductor when a disconnect signal is received from said safety sensor; and a thermostatic control electrically coupled to said sensor conductor, said thermostatic control detecting a temperature of said blanket and thereby regulating electrical power supplied to said resistive heating conductor.

15. A heating element, comprising:

a resistive heating conductor having at least one strand;

a first electrical insulation surrounding said resistive heating element;

a sensor conductor helically disposed around said first electrical insulation; and a second electrical insulation surrounding both said sensor conductor and said first electrical insulation, said second electrical insulation having a higher melting temperature than said first electrical insulation.

* * * * *